United States Patent [19]

Gurries

[11] 4,387,859

[45] Jun. 14, 1983

[54] RESONANTLY-POWERED CRUSHER

[75] Inventor: Raymond A. Gurries, Reno, Nev.

[73] Assignee: Resonant Technology Co., Sparks, Nev.

[21] Appl. No.: 263,848

[22] Filed: May 15, 1981

[51] Int. Cl.[3] ..... B02C 1/04; B02C 19/18

[52] U.S. Cl. ..... 241/262; 241/266

[58] Field of Search ..... 241/262, 263, 264, 265, 241/266, 301

[56] References Cited

U.S. PATENT DOCUMENTS

| | | | |
|---|---|---|---|
| 3,131,878 | 5/1964 | Bodine, Jr. | 241/262 |
| 3,414,203 | 12/1968 | Bodine | 241/301 X |
| 3,465,976 | 9/1969 | Vinitsky et al. | 241/262 X |
| 3,473,741 | 10/1969 | Bodine | 241/262 X |
| 4,026,481 | 5/1977 | Bodine | 241/266 |

FOREIGN PATENT DOCUMENTS

| | | | |
|---|---|---|---|
| 377167 | 5/1973 | U.S.S.R. | 241/266 |

*Primary Examiner*—Howard N. Goldberg

*Attorney, Agent, or Firm*—Townsend and Townsend

[57] ABSTRACT

A crusher for reducing the size of pieces of rock, concrete and the like is disclosed. A pair of resonant beams are suspended at their upper nodes from the upper end of a frame. The beams are driven by an oscillatory driver which engages the beams near their anti-nodes. A pair of opposed jaws are mounted at the lower ends of the beams and their mutual, reciprocal action applies compressive forces to material fed therebetween which causes the material to break apart. The jaws may be moved apart by a pair of hydraulic cylinders to allow adjustment of the material size discharged from the crusher. The hydraulic system actuating the cylinders is especially adapted to absorb shock imparted by the reactive forces of the jaws against the material being crushed.

9 Claims, 6 Drawing Figures

RESONANTLY-POWERED CRUSHER

BACKGROUND OF THE INVENTION

1. Field of the Invention

The present invention relates generally to crushers for rocks, ores, and the like, and more particularly to a crusher having opposed crushing jaws which are driven by resonantly-excited beams.

2. Description of the Prior Art

Crushing raw materials to reduce them to a smaller size is a process basic to many industries. Such crushing typically takes place in several stages with large pieces of, for example, mineral ore being fed first to a jaw-type crusher which breaks the ore down into pieces which are several inches across. Such crushers typically include a reciprocable jaw adjacent a fixed wall. Either the surface of the jaw, the wall, or both, is inclined so that the jaw and the wall define a chamber having a decreasing width in the downward direction. By feeding the ore to the chamber and by driving the jaw periodically inward against the wall, the ore is broken down into successively smaller pieces as it moves downward. Once the ore has been broken into pieces corresponding to the maximum distance between the lower ends of the jaw and the wall, it falls to a receptacle or conveyer for further processing. Crushers of this type normally operate continuously with the larger pieces being fed on top urging those pieces below downward so that they will be crushed.

Upon discharge from the jaw-type crusher, the ore may be fed to a cone crusher for further size reduction. The cone crusher discharges material a fraction of an inch across. This material may then be fed to a ball (or rod) mill to produce a fine, particulate material in a broad range of mesh sizes.

It is thus desirable to provide a jaw-type crusher which would reduce the material size sufficiently so that additional stages of crushing would no longer be necessary to produce a broad range of material sizes.

Typically, jaw-type crushers have been powered by mechanical means which apply force directly between the jaw and the frame of the crusher. While such a construction has proven workable, it suffers from severe maintenance problems resulting from the stress placed on the frame. It is thus desireable to provide a crusher where the crushing jaw is powered by means which impart little or no force to the frame of the crusher.

In order to reduce vibrations, attempts have been made to power jaw-type crushers using horizontally-mounted beams to drive a pair of crushing jaws mounted to receive feed material therebetween. See, for example, U.S. Pat. Nos. 3,131,878; 3,284,010; and 3,414,203. In each of these, a standing, longitudinal wave is induced in the beams to cause the jaws to reciprocate relative to each other. In order to function properly, such machines require very long beams which greatly increase the cost of constructing the machine. If the beams are shortened, the crusher operates at high frequency and low amplitude, characteristics which are not effective in most crushing operations.

It is known to reciprocally drive devices by placing them at an anti-node of a member which is vibrating transversely at or near its resonant frequency. See, for example, U.S. Pat. Nos. 3,232,669 and 3,367,716 to Bodine, which disclose the theoretical advantages in using such resonant systems to apply large forces. It is unknown, however, to combine such transverse resonant drive means in opposed relation in a crusher for rocks, ores and the like to achieve the objects of the present invention as set forth above.

SUMMARY OF THE INVENTION

The present invention is a crusher capable of imparting very large compressive forces to large pieces of rocks, ores and the like, with minimum reactive force being experienced by the frame of the crusher. It accomplishes this by providing a pair of opposed jaws mounted at the lower anti-nodes of two resonant beams suspended from their upper nodes on the frame. By exciting the beams synchronously, but 180° out of phase, the jaws reciprocate inward to pulverize any object caught therebetween.

Since the resonant beams are supported at their nodes, the oscillatory forces exciting the beams will not be transmitted to the frame. Moreover, the reaction force resulting from the impact of each jaw on the feed material is balanced by an equal but opposite force experienced by the other jaw since the jaws are driven in an opposed manner, that is, 180° out of phase. Thus, the only portions of the crusher which experience stress are horizontal members which restrain the lower nodes of the beams, both of which experience a periodic tensile force whenever the jaws engage a rock. Since the forces are balanced, however, the frame as a whole will experience little vibration and the problems associated with stress and fatigue found in the prior art crushers are avoided.

An additional advantage of the present invention results from the efficient transfer of energy resulting from the use of a resonant system. Since a greater percent of the input energy is transferred to the material being broken, the material can be broken into smaller pieces than by conventional means and the need for further processing in a cone crusher and a ball mill may be reduced or eliminated entirely.

In the preferred embodiment, a pair of substantially similar resonant beams are mounted at their upper nodes from the upper end of an elongate vertical frame. A pair of oscillatory drivers, typically mounted at the upper end of each resonant beam at a point coincident with the beam's anti-node, are driven synchronously, but 180° out of phase, to induce a standing lateral wave in the beam. The jaws, which are mounted at the lower ends of the beams at or near the anti-nodes, are thus able to apply successive compressive forces to the material fed in from above. Means for restraining the outward movement of the beams is provided to prevent the beams from moving apart as the jaws engage the feed material. Such means will typically comprise a pair of back-up bars disposed adjacent the outer face of each beam substantially at the lower-node thereof. By connecting the back-up bars with two hydraulic cylinders, the restraining means is able to adjust the distance between the jaws to vary the size of the material discharged therefrom. Additionally, the hydraulic system for the cylinders may be adapted to absorb shock created by the impact of the jaws on the feed material.

The use of transversely-excited resonant beams instead of longitudinally-excited beams, as in the prior art, allows the crushing jaws to be driven at a frequency and with an amplitude which provides efficient crushing. Moreover, the resulting machine is more compact than that of the prior art, resulting in substantial savings in construction costs.

The novel features which are characteristic of the invention, as to organization and method of operation together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
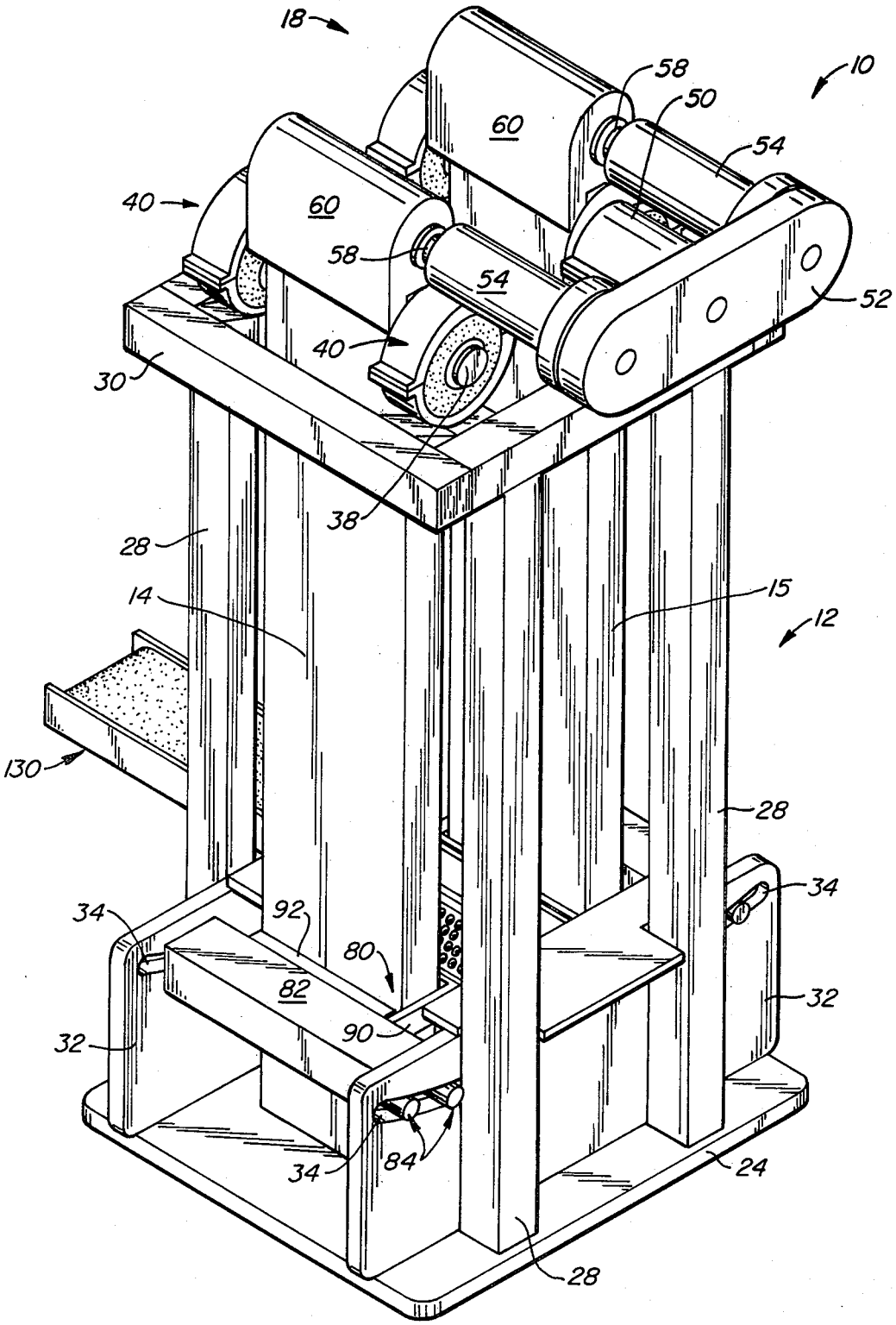
FIG. 1 is a perspective view of the crusher of the present invention.
Figure 2:
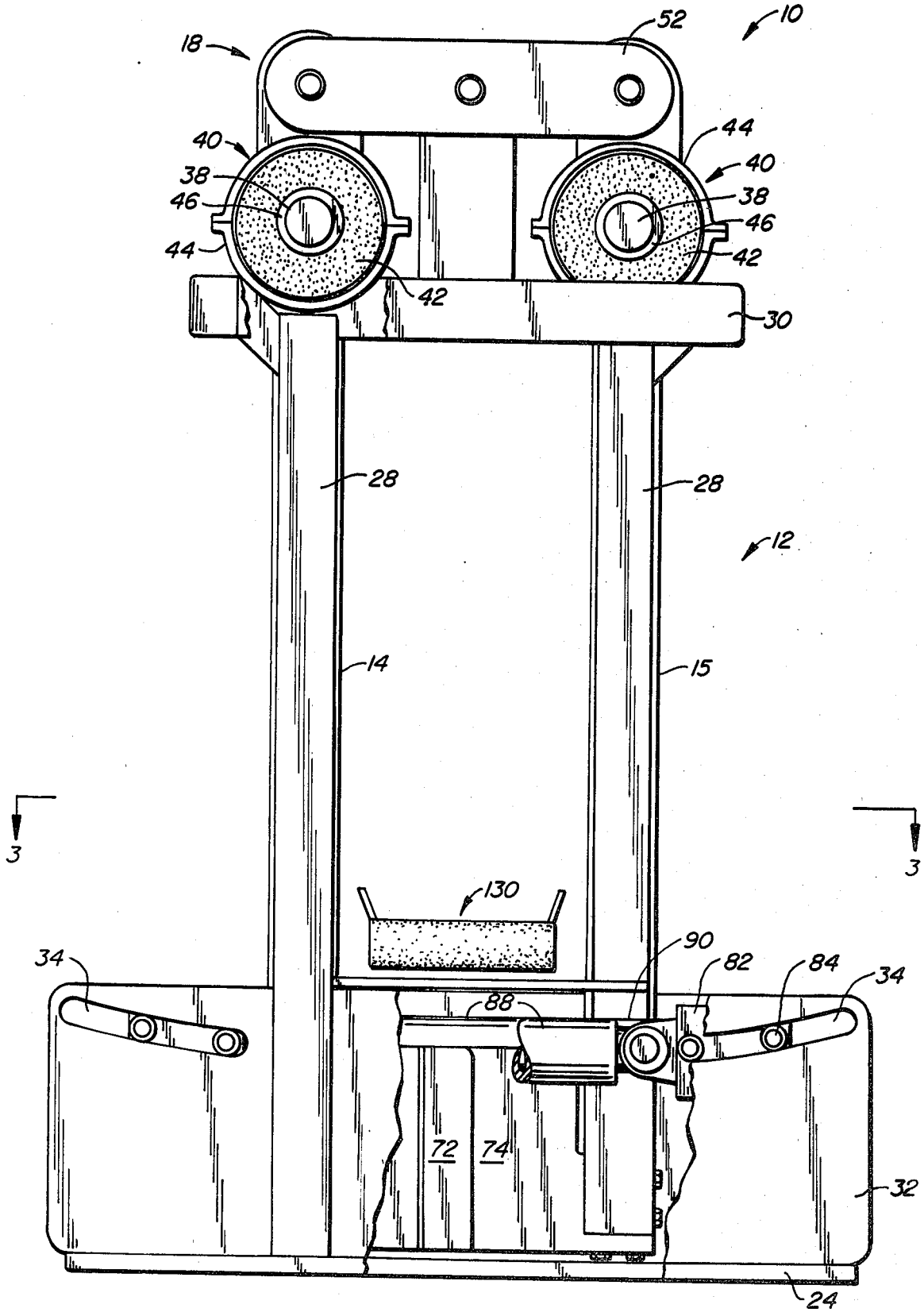
FIG. 2 is a front elevational view of the crusher with portions being broken away.

Referring to FIGS. 1 and 2, the crusher 10 of the present invention includes a frame 12, a pair of resonant beams 14, 15, suspended from the upper end of the frame, an oscillatory driver 18 for exciting the resonant beams, and a pair of opposed jaws 20, 21 (FIGS. 3 and 4), one attached at the lower end of each resonant beam. The frame 12 includes a base plate 24 having a large opening 26 (FIG. 4) therethrough for discharging crushed material, four vertical posts 28 projecting upward from the base plate 24, a horizontal frame 30 mounted at the top of the posts 28 and adapted to support the oscillatory driver 18, as described in detail hereinafter, and a pair of side plates 32, each having a pair of arcuate slots 34 therethrough. The side plates 32 are secured at their lower edges to the base plate 24 and spaced apart so that each lies adjacent to a pair of the vertical posts 28, as illustrated in FIG. 1. The lower ends of the resonant beams 14, 15 and the jaws 20, 21 are received into the space between the side plates 32.

The resonant beams 14, 15 are matched heavy steal plates each having a rectangular cross section with a width equal to the maximum anticipated dimension of the feed material and a thickness and length chosen to provide the proper frequency, amplitude and power transmission characteristics for the system as a whole. The beams 14, 15 are matched in the sense that they resonate at the same frequency, have the same dimensions and are made from the same material. When resonantly excited, as described hereinafter, the beams will each have upper and lower nodes spaced inward from the upper and lower ends respectively, and anti-nodes located at each end and at the middle. The nodes are the point of zero lateral displacement while the anti-nodes are the points of maximum lateral displacement.

The beams are each supported on a shaft 38 extending through the beam along a line substantially coincident with the upper node. Each end of the shaft 38 is received in a shock absorbing mount 40 adapted to isolate the resonant beam from the frame. As best illustrated in FIG. 2, the shock absorbing mounts 40 each include an inner bearing (not shown) surrounded by resiliant material 42 which is housed within an outer shell 44. A retaining ring 46 secured at each end holds the shaft 38 in place. The four shock absorbing mounts 40 are each supported at the upper end of one of the vertical posts 28 and secured to the frame 30 as well as the associated post.

The oscillatory driver 18 is adapted to impart reciprocating lateral forces to each of the resonant beams 14, 15 so as to induce a standing lateral wave therein. The lateral forces required may be applied at either the upper or middle anti-node, although it is more convenient to mount the driver 18 at the upper ends of the beams as illustrated herein.

The oscillatory driver 18 includes a motor 50, typically a hydraulic motor, a gear box 52 which simultaneously rotates a pair of double universal joints 54 at the same speed but in opposite directions, and one or more eccentric weights 56 (FIGS. 5A and 5B) which are mounted on shafts 58 coupled directly to the universal joints 54 and housed in a chamber formed in the upper end of the beams 15, 16 beneath a protective covering 60. The operation of the eccentric weights will be described in detail hereinafter.

Figure 3:
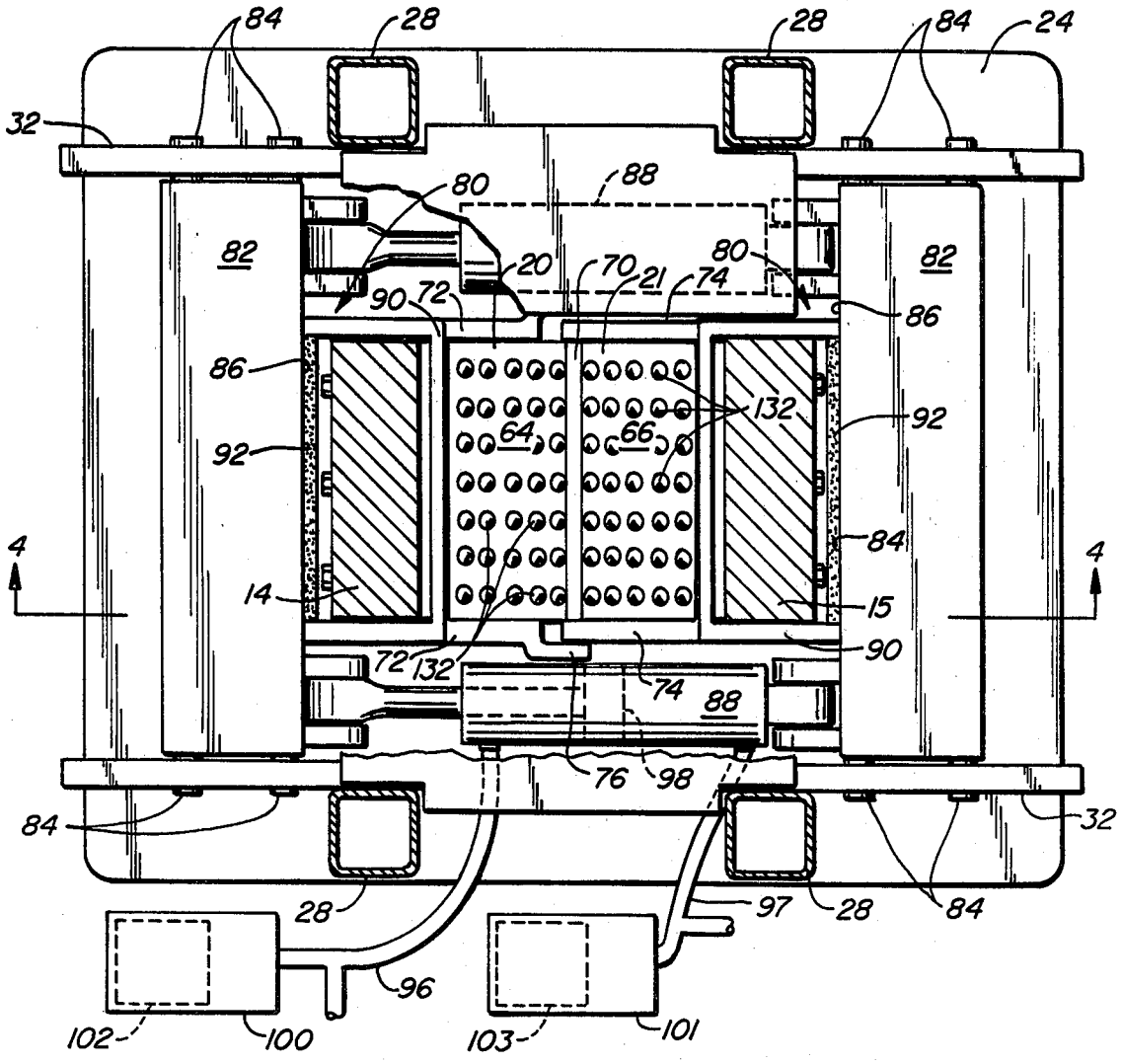
FIG. 3 is a transverse sectional view of the crusher taken along line 3—3 of FIG. 2.
Figure 4:
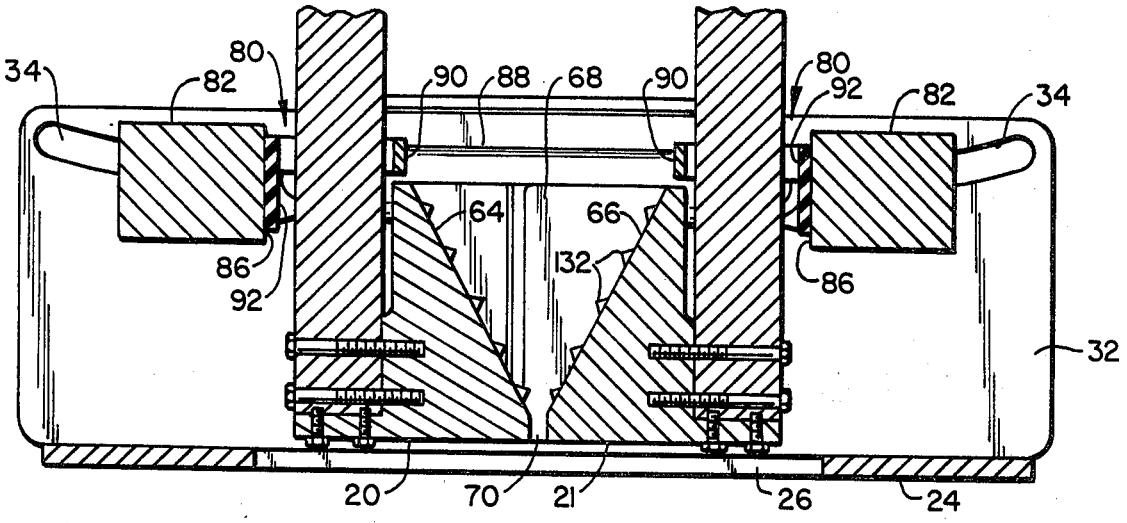
FIG. 4 is a detailed sectional view of the lower portion of the crusher taken along line 4—4 of FIG. 3.

The jaws 20, 21 are formed from impact and abrasion resistant material and their particular shape will vary depending on the nature of the feed material. Referring now particularly to FIGS. 3 and 4, the jaws 20, 21 will typically have opposed, inclined faces 64, 66 which define a cavity having a wide opening 68 at the top and tapering to a narrow discharge slot 70 at the bottom. The remaining two sides of the cavity are defined by side plates 72, 74 which are secured at either side of the jaws 20, 21, respectively. The side plates 72 on jaw 20 terminate at their right end (as viewed in FIGS. 3 and 4) in a lip 76 adapted to enclose side plates 74 on jaw 21 regardless of the distance between the jaws 20 and 21. In this way, the cavity remains confined as the jaws 20, 21 reciprocate and material is prevented from dropping out. Alternatively, a stationary side plate (not shown) may be provided adjacent to the sides of the jaws 20, 21 to define the cavity. The latter approach is less desirable since abrasion is likely to occur between the moving jaws 20, 21 and such a stationary side plate.

The jaws 20, 21 may be adapted to intermesh at their lower ends so that the feed material will be pulverized to a fine mesh. In this case, the slot 70 will be defined by a plurality of teeth (not shown) on each jaw which reciprocate inward as the jaws are driven.

As stated hereinbefore, the resonant beams 14, 15 are pivotally supported at their upper ends on shafts 38. Although the resonant beams 14, 15 are not secured to the frame at any other point, a restraining frame 80 is provided to limit the outward motion of each resonant beam near its lower end. The restraining frame 80 comprises a pair of back-up bars 82 having rollers 84 at each end which are received within the slots 34 in the side plates 32, as best illustrated in FIG. 1. The relative orientation of the rollers 84 and the slots 34 is such that the inward face 86 (that is, the generally vertical face of the bar 82 disposed toward the center of the machine) is maintained parallel to the plane of the associated resonant beam 14 or 15 as the lower end of the beam moves inward and outward.

A bracket 90 is provided on the interior face 86 of each back-up bar 82 and completes the enclosure of the associated resonant beam 14, 15. A resilient pad 92 is also provided on the interior face 86 of the back-up bar and acts to absorb reactive forces generated as the jaw impacts against the feed material.

The back-up bars 82 are connected by a pair of hydraulic cylinders 88 which may be adjusted to vary the distance between the jaws 20, 21 as required by the particular application. The cylinders 88 may also be used to move apart the jaws 20, 21 to clear material which becomes jammed therebetween. Each cylinder 88 is connected by a pair of flexible hoses 96, 97 (FIG. 3) to a hydraulic system, not shown. The hoses 96, 97 are connected to either side of a piston 98 within the cylinder 88 and pressure applied to line 97 causes the cylinder to open, while pressure applied to line 96 causes the cylinder to close.

In addition to providing the operative means for opening and closing the jaws 20, 21, the hydraulic system is provided with accumulators 100, 101 (FIG. 3) to aid in absorbing the reactive forces generated when the jaws are in operation. The accumulators 100, 101 are each provided with internal air-filled bladders 102, 103 to absorb forces which are transmitted to the cylinders 88 and thus to the hydraulic system. Since the reactive forces will normally be directed outward, the force will act to draw the piston 98 outward, or to the right as viewed in FIG. 3. Thus, the accumulator 100 will normally be sized larger to absorb a major portion of the reactive forces.

Figure 5A:
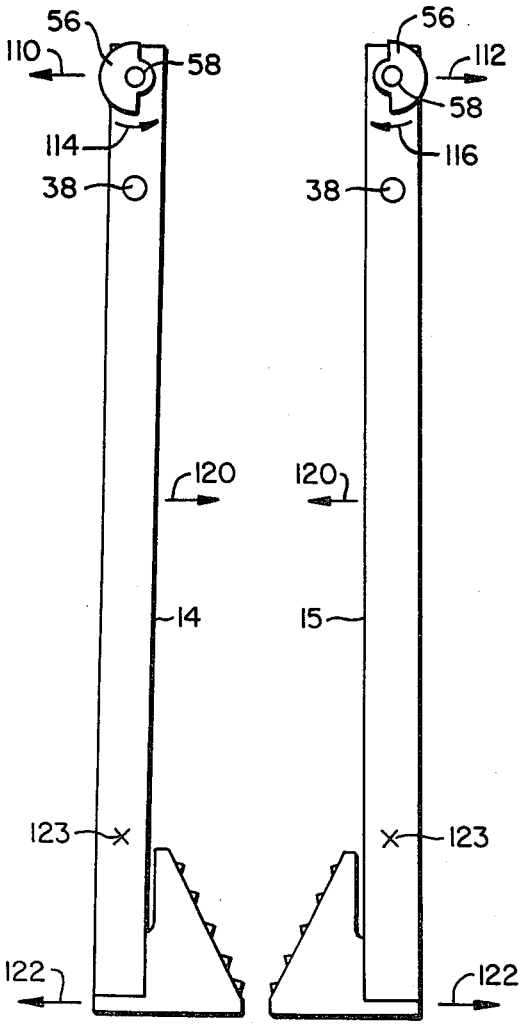
FIGS. 5A and 5B are schematic views of the resonant beams illustrating the movement induced by the oscillatory driver.
Figure 5B:
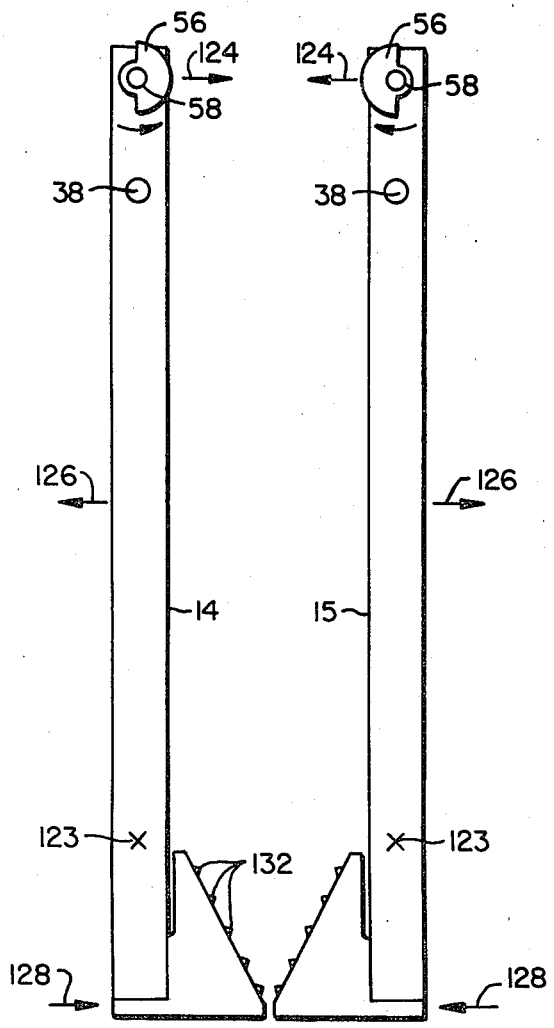

Referring now to FIGS. 5A and 5B, the resonant characteristics of the beams 14, 15 will be explained. The beams 14, 15 depend vertically from the shafts 38 and are otherwise unsupported. The shaft 58 is journaled through the upper end of each beam 14, 15 and has one or more eccentric weights 56 mounted thereon, as described hereinbefore. The weights are driven synchronously, but 180° out of phase by the oscillatory driver 18, as illustrated in both FIGS. 5A and 5B, and each weight exerts an outward centrifugal force as it rotates.

Referring particularly to FIG. 5A, the weight 56 at the top of beam 14 would be exerting a lateral force in the direction of arrow 110 while the weight 56 at the top of beam 15 would be exerting force in the opposite direction, as indicated by arrow 112. While the weights may be driven in either direction, for the purposes of illustration the weight 56 on beam 14 is shown to rotate counterclockwise as indicated by arrow 114, while the weight at the top of beam 15 is shown to rotate clockwise, as indicated by arrow 116. Thus, FIG. 5A illustrates the weights 56 at the moment they are exerting the maximum outward lateral forces on the beams 14, 15. The maximum lateral displacement at the upper anti-nodes will follow a short time later due to the inertia of the beams. In FIG. 5B, the weights 56 at the top of beams 14, 15 are illustrated at the moment they are exerting their maximum inward force on the beams. Again, the maximum inward displacement of the upper anti-nodes will occur a short time after the maximum force has been imparted.

As the inward and outward forces applied to the upper anti-nodes of the beams 14, 15 alternate, a lateral standing wave is induced in the beam. In FIG. 5A, as the upper anti-node of each beam is moving outward, the middle anti-node is moving inward as illustrated by arrows 120. Similarly, the lower anti-nodes are moving outward as illustrated by arrows 122. The upper node (coincident with shaft 38) and the lower node at 123, of course, remain substantially stationary. Referring now to FIG. 5B, as the upper anti-nodes move inward, as indicated by arrows 124, the middle anti-nodes move outward (arrows 126) and the lower anti-nodes move inward (arrows 128). This 'S'-shaped wave pattern is repeated at the frequency induced by the oscillatory driver 18. Typically, the system will be driven at a frequency slightly below the resonant frequency to avoid overdriving the system.

In operation, the material to be crushed, typically rocks, mineral ore, concrete and the like, is continuously fed to the crusher 10 by a conveyer 130, illustrated in FIGS. 1 and 2. As the material is discharged from the conveyer 130, it falls downward into the cavity defined by the opposed faces 64, 66 of the crushing jaws 20, 21 which are driven by the oscillatory driver 18 in the above-described manner. The opposed faces 64, 66 of the jaws 20, 21 are provided with studs 132 (as illustrated in FIGS. 3 and 4) which bite into the feed material to help break the material apart as well as prevent said material from being pushed upward. As the jaws constrict about the feed material, the compressive forces transmitted cause fissures within the material and eventually cause the material to break into smaller pieces. As the jaws reciprocate, the smaller pieces fall further down to a point where the opposed faces 64, 66 are closer together. The process of cracking the material is repeated as the material falls further and further into the cavity until the material is finally discharged at a size determined by the width of the slot 70. Thus, the size of the material discharged can be selected by adjusting the spacing of the jaws using the restraining frame 80, as described hereinabove.

While the preferred embodiment of the present invention is illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. An apparatus for crushing large masses, the apparatus comprising:

a supporting frame;

a pair of resonant beams with similar resonant characteristics having anti-nodes at each end and nodes spaced inward from the ends, said beams being suspended from the frame at a location on each beam substantially coincident with the node proximate the upper end of the beam;

means for inducing a standing lateral wave in each of the beams at or near the resonant frequency of the beams so that the lower ends of the beams move toward and away from each other in a synchronous manner;

means mounted on the lower ends of the beams for striking the masses as they are fed to the apparatus and for imparting opposed compressive forces to the masses which result in the masses being crushed;

means for engaging the beams at the nodes proximate their lower ends to bias said beams toward one another at said lower nodes to counteract the reaction forces of the beams striking the masses.

2. An apparatus as in claim 1, wherein the means for inducing a lateral wave is attached to the upper end of both beams.

3. An apparatus as in claim 1, wherein the means for inducing a lateral wave includes:

a motor;

a first shaft operatively connected to the motor and received within the upper end of the first resonant beam;

a second shaft operatively connected to the motor and received within the upper end of the second resonant beam; and one or more eccentric weights mounted on each of the first and second shafts.

4. An apparatus as in claim 1, wherein the means for striking the masses and for applying compressive forces comprises a pair of opposed faces defining a cavity of decreasing width in the downward direction, the faces being operatively connected to the resonant beams and having means for penetrating the masses to initiate fissures in the masses as the compressive forces are applied by the resonant beams.

5. An apparatus for crushing solid material, the apparatus comprising:

a frame;

a first beam being composed of a solid homogenous material and having dimensions which impart a pre-determined resonant characteristic;

a second beam having dimensional and resonant characteristics substantially the same as the first beam;

means for suspending the first and second beams from the frame;

an oscillatory driver mounted on the beams to induce standing lateral waves in said beams which are mirror images of one another, the waves having an upper and a lower node and an upper, a middle and a lower anti-node;

a pair of jaws having inclined surfaces and mounted at the lower ends of the respective beams so that the jaws will oscillate therewith, the opposed inclined surfaces on the jaws defining a cavity with a large opening at the top for receiving the solid material and a narrow opening at the bottom for discharging the material after it has been crushed by the jaws; and means for spacing the jaws apart in the direction of their oscillation, the means for spacing being adjustable so that the size of material discharged through the narrow opening can be adjusted.

6. An apparatus as in claim 5, wherein the oscillatory driver includes:

a motor;

a first shaft extending through the upper end of the first beam along a line substantially coincident with the upper anti-node and having one or more eccentric weights secured thereto;

a second shaft extending through the upper end of the second beam along a line substantially coincident with the upper anti-node and having one or more eccentric weights secured thereto; and means for operably connecting the motor to both the first and second shafts.

7. An apparatus as in claim 5, wherein the means for spacing the jaws apart engages each beam substantially at the lower node thereof and biases the beams toward one another to counteract the reaction forces of the jaws striking the solid material.

8. An apparatus as in claim 5, wherein the means for spacing the jaws apart includes:

a means for encompassing the first beam slidably mounted on the frame;

a means for encompassing the second beam slidably mounted on the frame; and a means for moving the first encompassing means relative to the second encompassing means while allowing both encompassing means to slide relative to the frame.

9. An apparatus as in claim 8, wherein the means for moving comprises at least one hydraulic cylinder, a means for providing hydraulic fluid to the cylinder, and a means for absorbing shocks operably connected to the means for providing hydraulic fluid.

* * * * *